United States Patent [19]

Tanaka

[11] Patent Number: 4,998,328

[45] Date of Patent: Mar. 12, 1991

[54] BUCKLE DEVICE

[75] Inventor: Kohbun Tanaka, Niwa, Japan

[73] Assignee: Kabushiki Kaisha Tokai-Rika-Denki-Seisakusho, Aichi, Japan

[21] Appl. No.: 376,586

[22] Filed: Jul. 7, 1989

[30] Foreign Application Priority Data

Jul. 8, 1988 [JP] Japan ..... 63-90589[U]

[51] Int. Cl.[5] ..... A44B 11/26

[52] U.S. Cl. ..... 24/639

[58] Field of Search ..... 24/639, 633, 636, 637; 297/468; 280/801

[56] References Cited

U.S. PATENT DOCUMENTS

| | | | |
|---|---|---|---|
| 3,789,492 | 2/1974 | Klink | 24/639 |
| 3,806,999 | 4/1974 | Freni | 24/637 |
| 3,955,056 | 5/1976 | Lindblad | 24/639 X |
| 4,310,954 | 1/1982 | Lewis et al. | 24/636 |
| 4,339,854 | 7/1985 | Ikesue | 24/639 X |
| 4,391,023 | 7/1983 | Tanaka et al. | 24/633 |
| 4,543,694 | 10/1985 | Fohl | 24/639 X |

*Primary Examiner*—James R. Brittain

*Attorney, Agent, or Firm*—Oliff & Berridge

[57] ABSTRACT

A buckle device of the type into which a tongue plate is inserted and engaged therewith. The buckle device is equipped with a lever member having a first and a second end as well as a middle section. The first end of the lever member is engaged with a locking member, which is to be engaged with the inserted tongue plate to prevent it from being extracted from the buckle device. When the second end of the lever member is depressed, the lever member is displaced, using its middle section as the fulcrum, to release the engagement between the buckle device and the tongue plate. This lever member is equipped with a displacement section for displacing the fulcrum from the side of the first end to that of the second end when the second end is depressed. Thus, when the second end is depressed, the fulcrum of the lever member is displaced toward the second end, thereby gradually diminishing the lever ratio of the lever member.

20 Claims, 4 Drawing Sheets

BUCKLE DEVICE

BACKGROUND OF THE INVENTION

1. Field of the Invention

This invention relates to a buckle device which is used in a seat belt or the like.

2. Description of the Related Art

A buckle device used in a seat belt is equipped with a locking member which is to be engaged with a tongue plate for the purpose of locking the same. This locking member is designed to be displaceable in such a way as to release the lock of the tongue plate.

In some cases, the lock of the tongue plate in such a buckle device is released by means of a lever member using its middle section as the fulcrum.

FIG. 5 shows the mechanism of a buckle device of this type. In the example shown, a lock plate 10 serving as the locking member can be displaced in the vertical direction. When moved downwards, it is inserted into a through-hole 14 provided in a tongue plate 12, thereby locking the tongue plate 12 with respect to this buckle device. A lever 16 serving as the lever member is rotatably mounted, using its middle section as the fulcrum. When a push button 18 provided at that end of the lever 16 which is on the opposite side of the lock plate 10 is depressed downwards, that end of the lever 16 at which the lock plate 10 is provided is moved upwards to extract the lock plate 10 from the through-hole 14, thereby releasing the lock of the tongue plate 12.

In the above lever 16, the lever ratio K is determined as: $K=L1/L2>1$ so that the requisite force for operating the push button 18 can be relatively small. Accordingly, when the stroke for moving the lock plate 10 from the lock position to the release position is represented as S1, the stroke S2 for the push button 18 is to be represented as $S1\times K$. Thus, the buckle device is required to have a relatively large thickness before the stroke S2 can be ensured, which constitutes an obstacle to miniaturization of the device.

Diminishing the lever ratio K might naturally allow the stroke K to be reduced, and consequently, the device to be miniaturized. However, this results in the requisite force for operating the push button 18 being augmented, which makes the device hard to operate.

SUMMARY OF THE INVENTION

It is accordingly an object of this invention to make it possible to miniaturize, without involving any deterioration in operability, a buckle device of the type in which a locking member is moved to a lock-release position by means of a lever member using the middle section thereof as the fulcrum.

This invention is based on the fact that the coefficient of static friction is larger than the coefficient of dynamic friction. That is, the requisite force for operating the lever member to displace the locking member is at its maximum at the moment when the locking member starts to move, and diminishes gradually afterwards.

In accordance with this invention, there is provided a buckle device, comprising: a locking member which can move between a lock position and a release position; a lever member which has a first and a second end and which is moved downwards using its middle section between the first and second ends thereof as a fulcrum when the second end is depressed, thereby moving the locking member from the lock position to the release position; and a displacement section which is provided on the lever member and which moves in such a manner that the above-mentioned fulcrum is moved from the first end side to the second end side as the depressing of the second end continues.

In the buckle member of this invention having the above construction, depressing the second end of the lever member causes the fulcrum thereof to be moved, because of the displacement section, toward the second end, so that the lever ratio diminishes gradually. Thus, the locking member can be displaced with the maximum lever ratio when it starts to move. Accordingly, it provides a sufficient toggle effect, without involving any augmentation of the requisite force for operating the lever member.

As the lever ratio of the lever member diminishes, the stroke of the first end increases with respect to that of the second end. Accordingly, the stroke of the second end needed for moving the first end by a required distance can be smaller when compared with the case where the lever ratio is kept constant.

DETAILED DESCRIPTION OF THE PREFERRED EMBODIMENTS

An embodiment of this invention will now be described with reference to the accompanying drawings.

Figure 1:
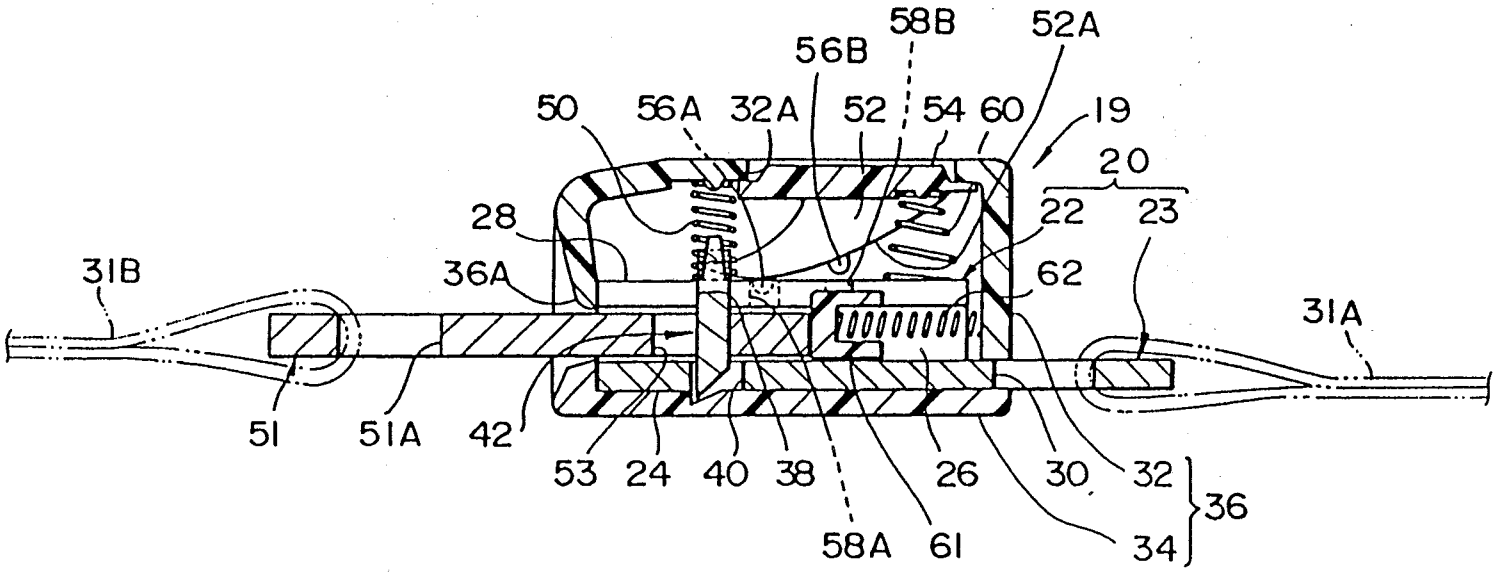
FIG. 1 is a sectional view of a buckle device in accordance with a first embodiment of this invention in the state in which a tongue plate is engaged with a lock plate; state in plate is engaged
Figure 2:
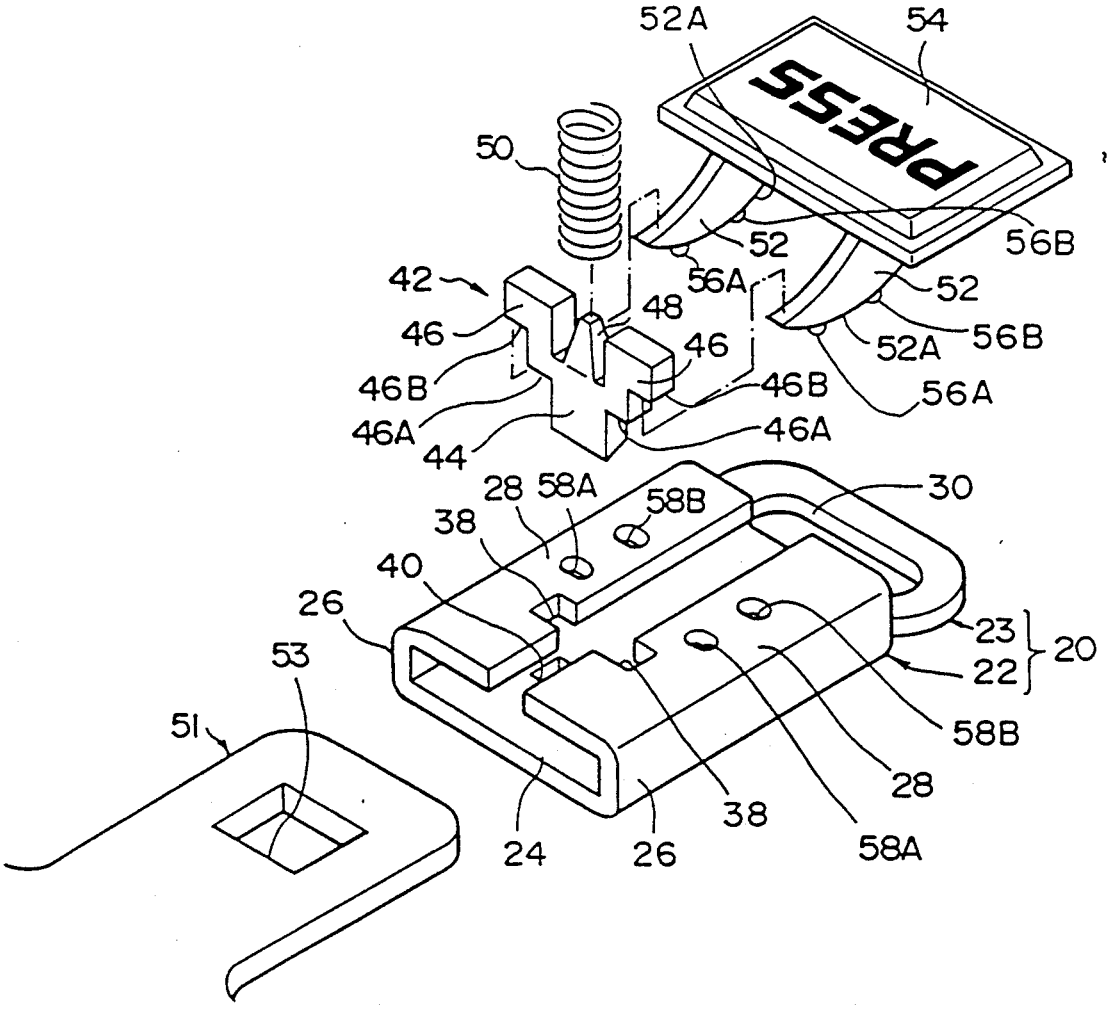
FIG. 2 is an exploded perspective view of an essential part of the embodiment shown in FIG. 1.

FIGS. 1 and 2 show an example of a buckle device to which this invention is applied. The example shown is of the type to be used in a seat belt.

The embodiment shown constitutes a buckle device 19 having a buckle body 20 which includes a body section 22 and a webbing attachment section 23. The body section 22 is formed as a member which has an approximately U-shaped section and which comprises a plate-like base 24, a pair of legs 26 rising perpendicularly from the ends of the base 24 and extending in parallel, and a pair of flanges 28 formed by bending the end sections of the legs 26 at right angles and extending toward each other. The body section 22 is covered with a buckle cover 36 which is composed of an upper cover 32 and a lower cover 34. The webbing attachment section 23 extends from the base 24 beyond the buckle cover 36, webbing 31A being attached to the webbing attachment section 23 by virtue of a webbing hole 30.

A pair of rectangular cutouts 38 facing each other are formed in the respective flanges 28 of the body section 22. Those sections of the base 24 which face the pair of cutouts 38 as well as that section of the base which is between these sections are cut out to form a rectangular through-hole 40.

Those sections of the flanges 28 which are on the side of the webbing attachment section 23 with respect to the cutouts 38 are narrower than the rest thereof.

The embodiment shown further includes a lock plate 42 which serves as the locking member. This lock plate 42 has a engagement section 44, a pair of first extensions 46 extending from the engagement section 44 and having a steplike symmetrical configuration, and a second extension 48 extending from the engagement section 44 and situated between the first extensions 46.

The lateral edge sections of the engagement section 44 of the lock plate 42 can be slidably fitted into the pair of cutouts 38. At the same time, the lower end (as seen in the drawing) of the engagement section 44 can be fitted into the through-hole 40. The lock plate 42. is urged downwards (as seen in FIG. 1) by means of a compression coil spring 50 whose ends are supported by the upper cover 32 and the second extension 48, causing first step surfaces 46A formed on the first extensions 46 to be pressed against the outer surfaces of the flanges 28. In this state, the lower end of the tongue plate 44 is engaged with the through-hole 40. From this position, the lower end of the engagement section 44 can be moved upwards, against the resilient force of the compression spring 50, to a position within the cutouts 38.

This lock plate 42 is to be engaged with a tongue plate 51 having a lock hole 53, through which the engagement section of the lock plate 42 can extend. The tongue plate 51 is inserted into the body section 22 of the buckle device through a tongue-plate insertion hole 36A provided in the buckle cover 36. The tongue plate 51 further includes a webbing attachment hole 51A by virtue of which webbing 31B is attached thereto.

The embodiment shown further includes a pair of levers 52 which serve as the lever member. Those ends of the levers 52 which are on the opposite side of the lock plate 42 are commonly fixed to a push button 54. The levers 52 are in contact with the outer surfaces of the flanges 28, and those ends of the levers 52 which engage with the lock plate 42 abut against, from below (as seen in the drawing), second step surfaces 46B formed on the first extensions 46. Those surfaces 52A of the levers 52 which face the flanges 28 are formed as convex surfaces, curved in an arc-like fashion. Formed on each of these surfaces 52A are two projections 56A and 56B, arranged in the longitudinal direction. These projections 56A and 56B can be fitted into respective support holes 58A and 58B formed in the flanges 28 and arranged in the longitudinal direction.

The push button 54 is urged counterclockwise (as seen in FIG. 1), around the center in the longitudinal direction of the levers 52, by means of a compression coil spring 60 provided between itself and the flanges 28. At its limit of rotation, the push button 54 closes an opening 32A provided in the upper cover 32.

The embodiment shown further includes an ejector 61 for forcibly extracting the tongue plate 51 from the body section 22 of the buckle body 20. The ejector 61 is slidably arranged between the respective inner surfaces of the base 24 and the flanges 28, and, at the same time, it is slidably retained between the opposite end surfaces of the narrower sections of the pair of flanges 28 in such a manner as to be movable in the longitudinal direction of the body section 22. Further, it is biased by a compression coil spring 62 provided between itself and the upper cover 32.

Figure 3:
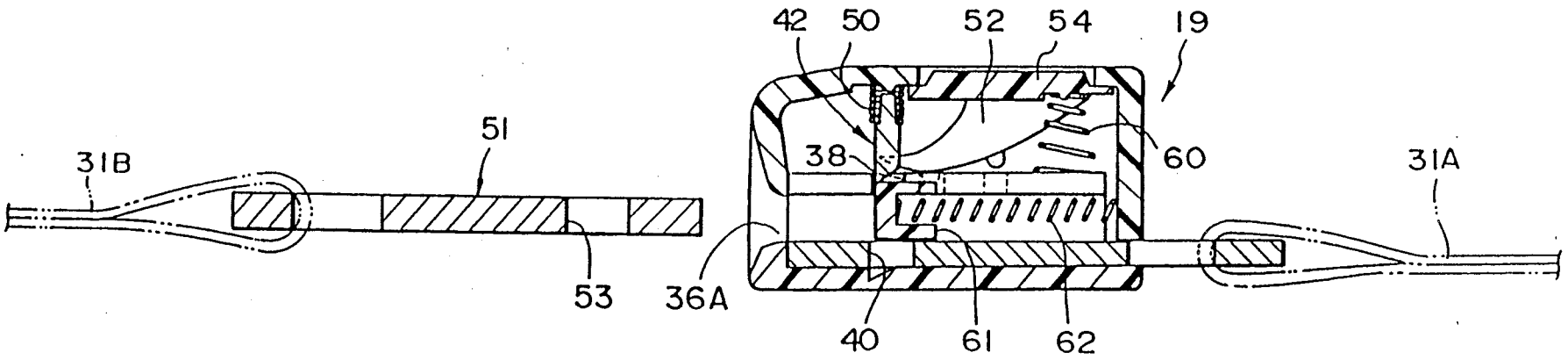
FIG. 3 is a sectional view of the buckle device of the first embodiment in the state in which the engagement between the tongue plate and the lock plate is released.

Under the condition in which the tongue plate 51 is out of the body section 22 of the buckle body 20, the ejector 61 is pressed against the end surfaces of the wider sections of the flanges 28 (as described below with reference to FIG. 3). In this state, the lower end of the engagement section 44 of the lock plate 42 is situated in the cutouts 38, and is pressed against the ejector 61 from above (as seen in the drawing).

The operation of this embodiment will now be described.

FIG. 1 shows the buckle device 19 in the condition in which it is engaged with the tongue plate 51. In this state, the first step surfaces 46A of the lock plate 42 are pressed against the flanges 28 by the resilient force of the compression coil spring 50, and the engagement section 44 of the lock plate 42 extends through the lock hole of the tongue plate 51, the lower end of the engagement section 44 being fitted into the through-hole 40. The ejector 61 is pressed against the tongue plate 51 by the resilient force of the compression coil spring 62, pressing the inner peripheral surface of the lock hole 53 against the lock plate 42.

As a result, the webbings 31A and 31B are connected to each other, and any load applied to the buckle device 19 through the webbings 31A and 31B, in the direction in which the tongue plate 51 is pulled out of the buckle device 19, is supported by both the tongue plate 51 and the buckle body 20 through the lock plate 42.

This lock state can be released by depressing the push button 54. In the condition before the push button 54 is depressed, the respective projections 56A of the levers 52 are fitted into the support holes 58A, the projections 56A serving as the fulcrum at the moment when the depressing of the push button 54 is started.

As the depression of the push button 54 continues, the levers 52 are rotated and move the second step surfaces 46B of the lock plate 42 upwards (as seen in FIG. 1), thereby causing the lock plate 42 to start to move upwards against the resilient force of the compression coil spring 50.

Since those surfaces 52A of the levers 52 which face the flanges 28 are curved in an arch-like manner, the rotation of the levers 52 causes those sections of the surfaces 52A which are in contact with the flanges 28 to be moved to the right (as seen in FIG. 1), the projections 56B starting to be inserted into the support holes 58B before the projections 56A have escaped from the support holes 58A. Thus, the surfaces 52A are prevented from sliding over the flanges 28.

As the rotation of the levers 52 progresses, the lock plate 42 is raised higher and higher (as seen in FIG. 1), allowing the lower end of the engagement section 44 to escape from the lock hole 53 of the tongue plate 51. At the same time, the ejector 61 is moved to the left (as seen in FIG. 1) by the resilient force of the compression coil spring 62, driving tongue plate 51 out of the buckle device. When reaching the cutouts 38 of the flanges 28, the ejector 61 comes to abut against the end surfaces of the wider sections of the flanges 28, so that any further movement is prevented.

When the depressing of the push button 54 has been terminated, the push button 54 is moved upwards (as seen in FIG. 1) by the resilient force of the compression coil spring 60, so that the levers 52 start to rotate in the direction reverse to that mentioned above. This causes the lock plate 42 to start to move downwards (as seen in FIG. 1) by virtue of the resilient force of the compression coil spring 50. However, any further movement of the lock plate 42 is prevented since the lower end of its engagement section 44 immediately comes to abut against the ejector 61. After the lock plate 42 has stopped its movement, the rotation of the levers 52 continues, the push button 54 moving to its end of rotation in the direction in which it is urged. Thus, the release condition as shown in FIG. 3 is attained.

If, in this condition, the tongue plate 51 is forced into the buckle device 19, the ejector 61 moves against the resilient force of the compression coil spring 62, the lock hole 53 of the tongue plate 51 being brought into alignment with the engagement section 44 of the lock plate 42. At the same time, the lock plate 42 is moved by the resilient force of the compression coil spring 50, thereby attaining the lock condition shown in FIG. 1.

Figure 4:
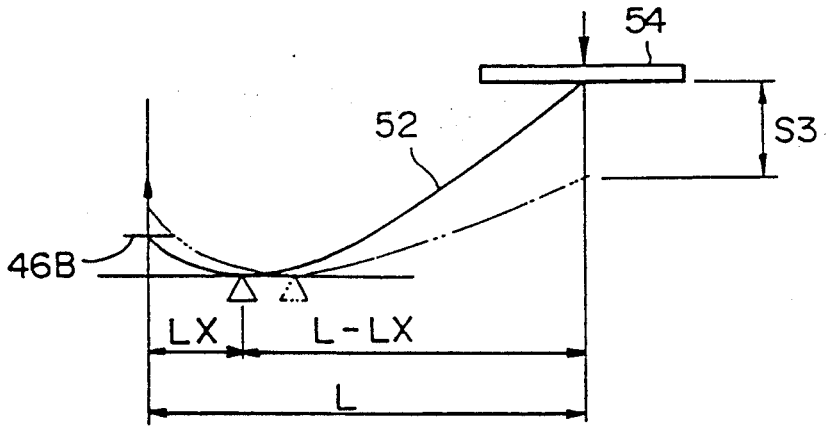
FIG. 4 is a diagram illustrating how the lever ratio changes.
Figure 5:
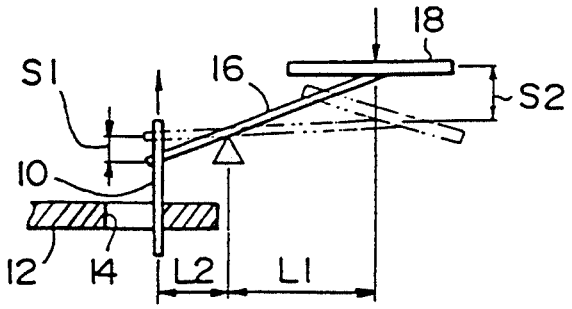
FIG. 5 PRIOR ART
FIG. 5 is a diagram illustrating the lever ratio in a conventional buckle device.

When releasing the engagement, the contact sections between the levers 52 and the flanges 28 is transferred to the right (as seen in FIG. 1). The resulting lever ratio K can be represented as: $K=(L-LX)/(LX)=L/LX-1$. Thus, as shown in FIG. 4, the lever ratio K gradually diminishes as LX increases.

At the moment when the levers 52 start to rotate, the frictions generated between the levers 52 and the lock plate 42, between the lock plate 42 and the buckle body 20, and between the lock plate 42 and the tongue plate 51, are to be considered in terms of the coefficient of static friction. These frictions are larger at this moment than when the rotation of the levers 52 has progressed.

The lever ratio K is at its maximum at the moment that the levers 52 start to rotate. Since this lever ratio K is set approximately equal to the lever ratio in conventional buckle devices, the push button 54 can be depressed with substantially the same force as in conventional devices, so that no deterioration in operability is involved.

As the depression of the push button 54 continues, the lever ratio K diminishes gradually. However, the friction after the levers 52 have started to rotate is of the type which is to be considered in terms of the coefficient of dynamic friction, so that the friction diminishes gradually. Accordingly, the requisite force for depressing the push button 54 does not augment, thus avoiding deterioration in operability.

Furthermore, since the change in the lever ratio K is effected smoothly, it does not cause the seat occupant to experience any unpleasant feeling when he or she operates the buckle device.

Moreover, by appropriately setting the curvature of the surfaces 52A of the levers 52 along with the curvature change thereof, the feel to the seat occupant when he or she operates the buckle device can be varied freely. Accordingly, a buckle device providing the most suitable feel can be realized with ease.

Since the lever ratio K thus diminishes gradually, the average value of the lever ratio K is smaller than that in conventional buckle devices. Accordingly, the distance by which the push button 54 is depressed, i.e., the stroke S3 (see FIG. 4), is smaller than in conventional devices, so that the thickness of the buckle device 19 (the dimension in the vertical direction of FIG. 1) can be smaller than in conventional devices.

While in the above-described embodiment the projections 56A and 56B provided on the surfaces 52A of the levers 52 and the support holes 58A and 58B provided in the flanges 28 constitute the means for preventing the surfaces 52A from sliding over the flanges 28; the same effect can be achieved if the projections 56A and 56B are provided on the flanges 28 and the support holes 58A and 58B are provided in the surfaces 52A.

As described above, this invention makes it possible to miniaturize, without involving any deterioration in operability, a buckle device of the type in which a locking member is moved to a release position by means of a lever member using its middle section as the fulcrum. This results from the arc-like curved configuration of the lever member which allows the lever ratio to change.

What is claimed is:

1. A buckle device, comprising:

a body member;

a locking member which can move between a lock position and a release position;

a lever member which has a first end and a second end as well as a middle section situated therebetween, said first end contacting said locking member, said lever member being supported on said body member so as to pivot using infinitesimally consecutive points on said middle section of said lever member as fulcrums, such that though depression of said second end said locking member can be moved from said lock position to said release position; and a displacement section which is provided on said middle section of said lever member, said displacement section having a smoothly curved section extending from said first end to said second end on a lower side of said lever member so as to enable a point of contact to act as a fulcrum point with said body member and to move in such a manner that said fulcrum point is displaced from proximate said first end to proximate said second end as said second end of said lever member is depressed so that a ratio of displacement of said first end with respect to said second end is continuously increased as said second end is depressed.

2. A buckle device as claimed in claim 1, wherein said displacement section has a construction such that moving said contact point causes said fulcrum point to change its position continuously.

3. A buckle device as claimed in claim 2, further comprising a prevention means for preventing said lever member from making a sliding displacement when said depression is effected.

4. A buckle device as claimed in claim 3, further comprising a first biasing means for biasing said locking member in the direction of said lock position.

5. A buckle device as claimed in claim 4, further comprising a depressing section provided on said lever member and used to effect said depression.

6. A buckle device as claimed in claim 5, further comprising a second biasing means for biasing said depressing section in such a way as to retain said lever member in a non-depressed section.

7. A buckle device as claimed in claim 3, wherein when said body member has a tongue plate inserted into an open end in said body member, said locking member is set in said lock position and engaged with said tongue plate thereby preventing said tongue plate from being extracted from said body member.

8. A buckle device as claimed in claim 7, wherein said prevention means is provided between said body member and said displacement section.

9. A buckle device as claimed in claim 8, wherein said prevention means comprises first and second projections as well as first and second holes, said first and second projections being provided on one of said lever member and said body member and said first and second holes being provided on the other of said lever member and said buckle body respectively so that said first holes accommodate said first projections when said second end is not depressed, and said second holes accommodate said second projections when said second end is depressed.

10. A buckle device as claimed in claim 9, wherein the respective positions of said first and second projections and those of said first and second holes are determined such that said second projections start to be inserted into said second holes before said first projections have come out of said first holes.

11. A buckle device of the type into which a tongue plate is inserted and engaged therewith, comprising:

a buckle body into which said tongue plate is inserted;

a locking member which can move between a first position in which said locking member is engaged with said tongue plate inserted into said buckle body so as to prevent said tongue plate from being extracted from said buckle body, and a second position in which said locking member is released from the engagement with said tongue plate, allowing said tongue plate to be extracted from said buckle body;

a lever member which is equipped with a first end and a second end as well as a middle section supported on and held in contact with said buckle body and which is displaced through depression of said second end so as to pivot using infinitesimally consecutive points on said middle section of said lever member as fulcrums, thereby moving said locking member from said first position to said second position, said first end contacting and lifting said locking member; and a displacement section which is provided in said middle section of said lever member said displacement section having a smoothly curved section extending from said first end to said second end on a lower side of said lever member so as to enable a contact point as a fulcrum point with said buckle body to be continuously displaced from proximate said first end to proximate said second end as said depression continues so that a ratio of displacement of said first end with respect to said second end is continuously increased as said second end is depressed.

12. A buckle device as claimed in claim 11, further comprising a prevention means for preventing said lever member from making a sliding displacement with respect to said buckle body when said depression is effected.

13. A buckle device as claimed in claim 12, wherein said prevention means is provided between said buckle body and said curved section.

14. A buckle device as claimed in claim 13, wherein said prevention means is equipped with first and second projections as well as first and second holes, said first and second projections being provided on either one of said curved section and said buckle body and said first and second holes being provided on the other of said curved section and said buckle body respectively so that said first holes accommodate said first projections when said second end is not depressed and said second holes accommodate said second projections when said second end is depressed.

15. A buckle device as claimed in claim 14, wherein the respective positions of said first and second projections and those of said first and second holes are determined such that said second projections start to be inserted into said second holes before said first projections have come out from said first holes.

16. A buckle device as claimed in claim 14, wherein said first and second projections are formed on said curved section, and wherein said first and second holes are formed in said buckle body.

17. A buckle device as claimed in claim 14, wherein a push button for effecting said depression is provided at said second end of said lever member.

18. A buckle device as claimed in claim 17, further comprising a first spring means for biasing said locking member in the direction of said first position thereof and a second spring means for biasing said push button in such a manner that said lever member is retained in a released position.

19. A locking buckle device, comprising a buckle body, said buckle body having an opening at one end for receiving a tongue plate;

a locking member slidably received in the upper surface of said buckle body, said locking member capable of moving between a lock position to engage the tongue plate and a release position to permit the tongue plate to be removed from the locking buckle device;

a lever member, said lever member further comprising a first end, a second end, and a center section having a curved lower surface therebetween, said lever member is supported on said buckle body so as to pivot using a contact point between said center section of said lever member and said buckle body as a fulcrum that moves continuously from a position adjacent said first end, said first end movably contacting said locking member, to a position adjacent said second end when said second end is depressed, depression of said second end causing said locking member to be moved to said release position by means of said locking member movably contacting said first end; and prevention means for preventing said center section of said lever member from sliding on said buckle body as the depression of said second end is effected, said prevention means comprising first and second projections and first and second holes, said first and second projections provided on one of said curved lower surface of said center section of said lever arm and said buckle body and said first and second holes provided in an opposing other of said curved lower surface of said center section of said lever arm and said buckle body respectively so that said first holes receive said first projections when said second end is not depressed and said second holes receive said second projections when said second end is depressed.

20. A buckle device of the type into which a tongue plate is inserted and engaged therewith, comprising:

a buckle body into which said tongue plate is inserted;

a locking member slidably received in an opening in the upper surface of said buckle body, said locking member capable of movement between a first position in which said locking member is engaged with the tongue plate inserted into said buckle device so as to prevent said tongue plate from being extracted from said buckle body and a second position in which said locking member is released from the engagement with the tongue plate allowing said tongue plate to be extracted from said buckle body;

a lever member which is equipped with a first end, a second end and a middle section therebetween, said middle section supported on and held in contact with said buckle body, said contact displaced through depression of said second end using said middle section as a fulcrum thereby moving said locking member from said first position to said second position, said depression of said second end causing said locking member to be moved to said release position by means of movable contact with said first end of said lever member;

a displacement section provided in said middle section of said lever member, said displacement section comprising a curved section which is convex on a side facing said buckle body and which extends in a direction in which said first end and said second end lie, said displacement section causing the position of said fulcrum to be displaced toward said second end as said depression continues; and a prevention means for preventing said lever member from making a sliding displacement with respect to said buckle body when said depression is effected, said prevention means provided between said buckle body and said curved section and comprising a first projection and a second projection, said first and second projections being provided on one of said curved section and said buckle body, and a first hole and a second hole, said first and second holes provided in an opposing other of said curved section and said buckle body respectively so that said first holes receive said first projections prior to depression of said second end and said second holes receive said second projections when said second end is depressed.

* * * * *